US007113024B2

(12) United States Patent
Freimuth et al.

(10) Patent No.: US 7,113,024 B2
(45) Date of Patent: Sep. 26, 2006

(54) CIRCUIT MODULE WITH HIGH-FREQUENCY INPUT/OUTPUT INTERFACES

(75) Inventors: Franz Freimuth, München (DE); Bernd Klehn, Unterhaching (DE); Ulrich Menczigar, Vaterstetten (DE)

(73) Assignee: Infineon Technologies AG, Munich (DE)

( * ) Notice: Subject to any disclaimer, the term of this patent is extended or adjusted under 35 U.S.C. 154(b) by 143 days.

(21) Appl. No.: 10/202,914

(22) Filed: Jul. 24, 2002

(65) Prior Publication Data

US 2003/0020537 A1 Jan. 30, 2003

(30) Foreign Application Priority Data

Jul. 24, 2001 (DE) ..... 101 35 964

(51) Int. Cl.
*G05F 1/10* (2006.01)
*G05F 3/02* (2006.01)

(52) U.S. Cl. ..... 327/538; 327/158

(58) Field of Classification Search ..... 327/538–541, 327/543, 157, 158
See application file for complete search history.

(56) References Cited

U.S. PATENT DOCUMENTS 5,604,775 A 2/1997 Saitoh et al. ..... 375/376
5,812,455 A * 9/1998 Iwata et al. ..... 365/185.18
5,929,696 A 7/1999 Lim et al. ..... 327/540
6,133,719 A * 10/2000 Maulik ..... 323/313
6,184,720 B1 2/2001 Kim et al. ..... 327/37
6,229,364 B1 * 5/2001 Dortu et al. ..... 327/158
6,275,079 B1 * 8/2001 Park ..... 327/143
6,333,864 B1 12/2001 Nishimura et al. ..... 363/78
6,411,142 B1 * 6/2002 Abbasi et al. ..... 327/156
6,469,551 B1 * 10/2002 Kobayashi et al. ..... 327/143
2002/0014914 A1 * 2/2002 Perque et al. ..... 327/543
2002/0079937 A1 * 6/2002 Xanthopoulos ..... 327/158

FOREIGN PATENT DOCUMENTS

JP 2001184863 A 7/2001

* cited by examiner

*Primary Examiner*—Quan Tra
(74) *Attorney, Agent, or Firm*—Laurence A. Greenberg; Werner H. Stemer; Ralph E. Locher

(57) ABSTRACT

The invention relates to a circuit module with high-frequency input/output interfaces, and in particular to a circuit realized on a chip, principally a monolithic integrated circuit having a phase-regulated circuit which is fed by externally applied voltages and an internal operating voltage generated on the basis of a trimmable internal reference voltage. According to the invention, each further internal operating voltage is derived from an individual reference voltage on the basis of an external voltage. An adjusting circuit is provided which adjusts the individual reference voltage using the trimmable internal reference voltage and then freezes it.

9 Claims, 1 Drawing Sheet

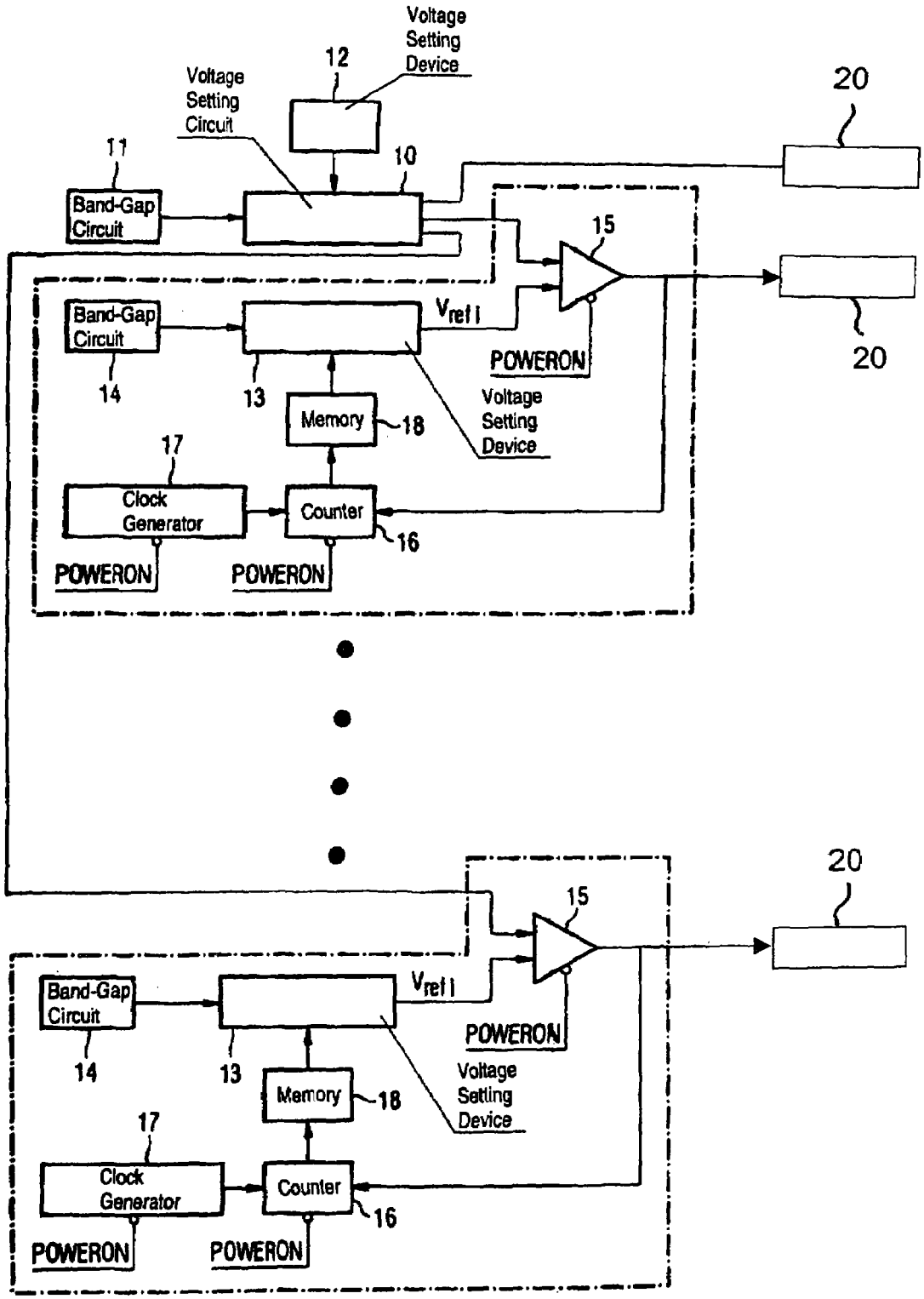
Voltage Setting Device
12
Voltage Setting Circuit
20
11
10
Band-Gap Circuit
15
Band-Gap Circuit
Vref1
POWERON
20
14
13
Memory
18
Voltage Setting Device
17
Clock Generator
Counter
16
POWERON
POWERON
20
15
Band-Gap Circuit
Vref1
POWERON
14
13
Memory
18
Voltage Setting Device
17
Clock Generator
Counter
16
POWERON
POWERON

CIRCUIT MODULE WITH HIGH-FREQUENCY INPUT/OUTPUT INTERFACES

BACKGROUND OF THE INVENTION

Field of the Invention

The invention relates to a circuit module with high-frequency input/output interfaces, and in particular to a circuit realized on a chip, principally a monolithic integrated circuit, having phase-regulated circuits that are fed by externally applied voltages and internal operating voltages that are generated based on individual reference voltages that can be set.

Such a circuit module is based on phase-regulated circuits, typically in the form of DLL (delay locked loop) circuits. The accuracy of these phase-locked loops and thus of the circuit module overall depends on a stable voltage supply.

Japanese Patent Abstract JP 2001-184863 A discloses a circuit module based on phase-regulated circuits. In this case, the individual reference voltages of the internal voltage supply stages in the circuit module can be set externally after production. A similar circuit module is described in U.S. Pat. No. 5,929,696.

As a result of disturbances during operation, for example, as a result of voltage dips as far as ground level in the main power supply, known as so-called voltage bumps, the reference voltages change and thus so do the internal operating voltages derived therefrom. This unavoidably results in inaccuracies in the phase detection by the phase-regulated circuits. A direct consequence of this is the impairment of the set-up and hold conditions in the input/output interfaces of the circuit module.

A reference system with a plurality of reference voltages which is trimmable in order to ensure a stable voltage supply that is also insensitive to disturbances during operation is, however, ruled out in practice on account of the associated high outlay for trimming the individual reference voltages. This trimming is usually effected by using fuses that are either trimmed by laser or that are so-called electrical fuses.

SUMMARY OF THE INVENTION

It is accordingly an object of the invention to provide a circuit module of the type mentioned in the introduction which overcomes the above-mentioned disadvantages of the prior art apparatus of this general type.

In particular, it is an object of the invention to provide a circuit module of the type mentioned in the introduction, which has a plurality of phase-regulated circuits, in which a stable voltage supply is ensured in a simple manner. The stable voltage supply is independent of disturbances, in particular of disturbances in the main power supply during operation.

With the foregoing and other objects in view there is provided, in accordance with the invention, a circuit module including: high-frequency input/output interfaces having phase-regulated circuits being fed by externally applied voltages and internal operating voltages being generated based on individual reference voltages that can be set; and an adjusting circuit for adjusting each one of the individual reference voltages using a trimmable internal master reference voltage.

In accordance with an added feature of the invention, at least one of the internal operating voltages is derived from a trimmable internal master reference voltage based on one of the externally applied voltages.

In accordance with an additional feature of the invention, the point in time for adjusting at least one of the individual reference voltages is during a switch-on operation for the circuit module.

In accordance with another feature, of the invention, one of the individual reference voltages is generated based on a band-gap circuit.

In accordance with a further feature of the invention, the adjusting circuit includes a comparator receiving the trimmable master reference voltage and one of the individual reference voltages; and the comparator outputs a comparison result for setting one of the individual reference voltages.

In accordance with a further added feature of the invention, there is provided, a circuit for generating one of the individual reference voltages. The circuit for generating the one of the individual reference voltages has a voltage setting input. A counter acts on the voltage setting input of the circuit for generating the one of the individual reference voltages. The comparison result of the comparator is used to increment and/or decrement the counter.

In accordance with another added feature of the invention, a clock generator is provided for clocking the counter.

In accordance with yet an added feature of the invention, a buffer is provided for storing the count of the counter.

Accordingly, in the case of the circuit module under discussion, the invention provides for each internal operating voltage to be derived from an internal reference voltage on the basis of an external voltage. An adjusting circuit adjusts the individual reference voltage using an individual trimmable internal reference voltage and then freezes the-reference voltage.

In other words, according to the invention, a dedicated reference voltage is used for each additional internal operating voltage, but the reference voltage is not trimmed in a complicated manner, for example, by using fuses, but rather is adjusted independently using the single trimmable reference voltage, which thus represents a master reference voltage. The reference voltage obtained, after the adjustment, is maintained unchanged, and in particular, is decoupled from a change in the master reference voltage due to external disturbances such as, for instance, voltage bumps.

The adjustment of the respective individual or dedicated reference voltage using the master reference voltage is preferably effected at a point in time at which, at least with high probability, external disturbances are not expected. A particularly suitable point in time for this, which is preferably utilized in the case of the invention, is the switch-on operation or the so-called power-up for the circuit module. Freezing the automatic adjustment of the individual reference voltage or the individual reference voltages is thus effected together with the power-on signal, consequently at a point in time at which all the internal operating voltages are stabilized and as yet no disturbances occur on the supply system due to operation.

One advantageous development of the invention provides for each individual reference voltage to be generated by a band-gap circuit realized on the chip of the circuit module.

The adjusting circuit for adjusting the respective individual reference voltage may, in principle, be realized in different ways. In accordance with an embodiment that is preferred because it can be realized in a simple manner, it is provided that the adjusting circuit includes a comparator, to which the trimmable master reference voltage and the individual reference voltage are applied and whose comparison result present at its output serves for setting the individual reference voltage. Furthermore, the adjusting circuit preferably includes a counter which is driven by the output of the comparator in order to increment or decrement the counter. The counter acts on a setting input of a circuit for generating the individual reference voltage. Finally, the counter is preferably clocked by a clock generator.

In this design of the adjusting circuit, the power-on signal is preferably applied to the comparator and the counter, and if appropriate, to the clock generator for the automatic adjustment.

Other features which are considered as characteristic for the invention are set forth in the appended claims.

Although the invention is illustrated and described herein as embodied in a circuit module with high-frequency input/output interfaces, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

The single FIGURE of the drawing diagrammatically shows one embodiment of the voltage supply system for a circuit module with high-frequency input/output interfaces.

DESCRIPTION OF THE PREFERRED EMBODIMENTS

Referring now to the sole drawing FIGURE, there is diagrammatically shown one embodiment of the voltage supply system for the inventive circuit module with high-frequency input/output interfaces, which include a plurality of phase-regulated circuits 20 that are supplied by internal operating voltages of the voltage system. The voltage system includes a device 10, for example, a voltage setting circuit, for generating a master reference voltage. This master reference voltage is supplied with current by a band-gap circuit 11 that is connected to an external voltage and that can be set by a voltage setting device 12, which usually includes fuses in order to trim the master reference voltage. The internal master reference voltage Vref trimmed in this way is present at the output of the setting circuit 10 and represents, for example, a first internal operating voltage with which a phase-regulated circuit 20 is supplied.

In order to provide further internal operating voltages, the inventive voltage system includes, for each further internal operating voltage, a corresponding number of individual reference voltages which are generated by a corresponding number of setting devices 13. Each voltage setting device 13 is in turn supplied with current by an associated band-gap circuit 14. For setting the individual reference voltage using the voltage setting device 13, an arrangement of fuses is not used as in the case of the master reference voltage, but rather an adjusting circuit is provided which adjusts the individual reference voltage using the trimmed master reference voltage $V_{ref}$. The adjustment circuit freezes the individual reference voltage after the adjustment operation.

The adjusting circuit includes a comparator 15 having two inputs, to which the master reference voltage $V_{ref}$ and the individual reference voltage $V_{ref\,i}$ are applied. In the comparator, the voltages $V_{ref}$ and $V_{ref\,i}$ are thus compared and the comparison result is present at the output of the comparator 15. The output signal of the comparator 15 drives a counter 16 in order to increment or decrement the comparator 15 depending on whether the comparison result at the comparator output is less than or greater than a desired value. The counter 16 is clocked by a clock generator 17 and its output signal is buffer-stored in a memory 18, for example a register. This buffer-storage of the counter reading is optional, however, and is not essential for the function of the adjusting circuit. The counter reading, which if appropriate is buffer-stored in the buffer 18, is input into the control input of the voltage setting device 13 for setting the individual reference voltage $V_{ref\,i}$.

The adjustment operation by the adjusting circuit is preferably effected at a point in time at which as yet there are no disturbances on the supply systems of the circuit module. Typically, a suitable time for this is the point in time at which a power-on signal is generated by a power-up (switch-on operation) for the circuit module. This power-on signal is applied simultaneously to control inputs of the comparator 15, of the counter 16 and of the clock generator 17. As soon as the individual reference voltage $V_{ref\,i}$ is stabilized and a further stable internal operating voltage is thus ready for a phase-regulated circuit, the voltage $V_{ref\,i}$ is kept constant, i.e. stored in the voltage setting device 13 permanently until the next power-up. The function of the adjusting circuit is thus ended for the present operating sequence.

We claim:

1. A circuit module, comprising:

a plurality of phase-regulated circuits each being fed by an internal operating voltage corresponding to an individual reference voltage;

a plurality of adjusting circuits, each adjusting a respective one of the individual reference voltages, each said individual reference voltage being generated by an individual setting device, using a trimmable internal master reference voltage;

said trimmable internal master reference voltage representing a first one of the internal operating voltages; and said individual reference voltages each representing a further one of the internal operating voltages;

said adjusting circuit including a comparator receiving the trimmable master reference voltage and one of the individual reference voltages, said comparator outputting a comparison result for setting one of the individual reference voltages;

a circuit for generating one of the individual reference voltages, said circuit for generating the one of the individual reference voltages having a voltage setting input;

a counter acting on said voltage setting input of said circuit for generating the one of the individual reference voltages; and said comparison result of said comparator being used to perform an operation selected from a group consisting of incrementing and decrementing said counter.

2. The circuit module according to claim 1, wherein: a point in time for adjusting one of the individual reference voltages is during a switch-on operation for the circuit module.

3. The circuit module according to claim 1, comprising:

a band-gap circuit;

one of the individual reference voltages being generated based on said band-gap circuit.

4. A circuit module, comprising:

a plurality of phase-regulated circuits each being fed by an internal operating voltage corresponding to an individual reference voltage;

a plurality of adjusting circuits, each adjusting a respective one of the individual reference voltages, each said individual reference voltage being generated by an individual setting device, using a trimmable internal master reference voltage;

said trimmable internal master reference voltage being generated based on an externally applied voltage and being set by a voltage setting device including fuses to trim said trimmable internal master reference voltage;

said trimmable internal master reference voltage representing a first one of the internal operating voltages;

said individual reference voltages each representing a further one of the internal operating voltages;

said adjusting circuit including a comparator receiving the trimmable master reference voltage and one of the individual reference voltages, said comparator outputting a comparison result for setting one of the individual reference voltages;

a circuit for generating one of the individual reference voltages, said circuit for generating the one of the individual reference voltages having a voltage setting input; and a counter acting on said voltage setting input of said circuit for generating the one of the individual reference voltages;

said comparison result of said comparator being used to perform an operation selected from a group consisting of incrementing and decrementing said counter.

5. The circuit module according to claim 4, comprising: a clock generator for clocking said counter.

6. The circuit module according to claim 5, comprising: a buffer for storing a count of said counter.

7. A circuit module, comprising:

a plurality of phase-regulated circuits each being fed by an internal operating voltage corresponding to an individual reference voltage;

an adjusting circuit for adjusting one of the individual reference voltages using a trimmable internal master reference voltage, said trimmable internal master reference voltage being generated based on an externally applied voltage;

a circuit for generating one of the individual reference voltages, said circuit for generating the one of the individual reference voltages having a voltage setting input; and a counter acting on said voltage setting input of said circuit for generating the one of the individual reference voltages;

said adjusting circuit including a comparator receiving the trimmable master reference voltage and one of the individual reference voltages;

said comparator outputting a comparison result for setting of the individual reference voltages; and said comparison result of said comparator being used to perform an operation selected from a group consisting of incrementing and decrementing said counter.

8. The circuit module according to claim 7, further comprising a clock generator for clocking said counter.

9. The circuit module according to claim 8, further comprising a buffer for storing a count of said counter.

* * * * *